US011828435B1

(12) United States Patent
Doresky et al.

(10) Patent No.: US 11,828,435 B1
(45) Date of Patent: Nov. 28, 2023

(54) LIGHT ASSEMBLY WITH A MOUNTING ASSEMBLY

(71) Applicant: Hunter Fan Company, Memphis, TN (US)

(72) Inventors: Jack Doresky, Memphis, TN (US); Douglas Troy Mason, Memphis, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 18/045,847

(22) Filed: Oct. 12, 2022

Related U.S. Application Data

(63) Continuation-in-part of application No. 17/825,010, filed on May 26, 2022.

(51) Int. Cl.
*F21S 8/04* (2006.01)
*F21V 21/03* (2006.01)

(52) U.S. Cl.
CPC ..... *F21S 8/04* (2013.01); *F21V 21/03* (2013.01)

(58) Field of Classification Search
CPC ..... F21V 21/03; F21V 21/008; F21V 17/12
See application file for complete search history.

(56) References Cited

U.S. PATENT DOCUMENTS

| | | | | |
|---|---|---|---|---|
| 1,297,211 | A | 3/1919 | Magness | |
| 4,303,968 | A | 12/1981 | Goralnik | |
| 4,448,388 | A | 5/1984 | Dennis et al. | |
| 5,613,832 | A | 3/1997 | Su | |
| 5,725,190 | A * | 3/1998 | Cuthbertson | F04D 25/088 248/343 |
| 6,116,559 | A | 9/2000 | Lackey | |
| 6,171,062 | B1 | 1/2001 | Bucher et al. | |
| 6,203,279 | B1 * | 3/2001 | Moody | F16M 13/027 248/343 |
| 7,080,813 | B1 | 7/2006 | Frampton et al. | |
| 7,510,160 | B1 * | 3/2009 | Wang | F04D 29/601 416/246 |
| 11,118,730 | B1 * | 9/2021 | Davidenko | F24F 13/32 |
| 2003/0213883 | A1 * | 11/2003 | Fu-Liang | F04D 29/668 248/343 |
| 2004/0256531 | A1 | 12/2004 | Tang | |
| 2005/0006549 | A1 * | 1/2005 | Liu | F04D 25/088 248/343 |
| 2021/0048041 | A1 | 2/2021 | Gorali | |

FOREIGN PATENT DOCUMENTS

| | | | |
|---|---|---|---|
| CN | 203867995 | U | 10/2014 |
| EP | 2642195 | A1 | 9/2013 |
| WO | 2002001110 | A1 | 1/2002 |

OTHER PUBLICATIONS

Lowes, "Portfolio Silver Metal Ceiling Light Mount", https://www.lowes.com/pd/Portfolio-Silver-Metal-Ceiling-Light-Mount/3659582, accessed Feb. 25, 2022, 2 pages, US.

* cited by examiner

*Primary Examiner* — Leah Simone Macchiarolo
(74) *Attorney, Agent, or Firm* — McGarry Bair PC

(57) ABSTRACT

A light assembly for mounting to a light to a sloped surface using a hanger bracket and a downrod such that the light is suspended from the hanger bracket via the downrod.

20 Claims, 8 Drawing Sheets

LIGHT ASSEMBLY WITH A MOUNTING ASSEMBLY

CROSS-REFERENCE TO RELATED APPLICATION(S)

This application claims priority to and is a continuation-in-part of U.S. patent application Ser. No. 17/825,010, filed May 26, 2022, which is incorporated herein in its entirety.

FIELD OF INVENTION

This application is directed to a light assembly, and more specifically, to a mounting assembly for mounting the light assembly to a sloped ceiling.

BACKGROUND

Lights can be suspended from a ceiling or structure, such as in residential or commercial applications for illuminating a space or object. In many cases, the ceiling can be sloped with respect to a floor or ground surface.

BRIEF DESCRIPTION

In one aspect, the disclosure relates to a light assembly for mounting to a sloped ceiling defining a sloped surface and having an electrical junction box with a face opening onto the sloped surface. The assembly includes a hanger bracket having a top plate and a seat extending from the top plate, with the seat defining a downrod opening; a downrod having opposing first and second ends, and extending through the downrod opening. The light assembly also includes a ball mount affixed to the downrod proximate to the first end and seated within the seat to pivotally mount the downrod to the seat via the ball mount. A light can be affixed to the downrod proximate to the second end. The light assembly further includes a canopy having a central opening through which the downrod passes, with the canopy being located along the downrod between the ball and the light. A first fastener secures the hanger bracket to the junction box; and a second fastener secure the canopy to the hanger bracket independent of the downrod; whereby the downrod is free to pivot relative to the canopy because of the pivotal mounting of the downrod to the seat and the fastening of the canopy to the hanger bracket independent of the downrod.

DETAILED DESCRIPTION

Figure 1:
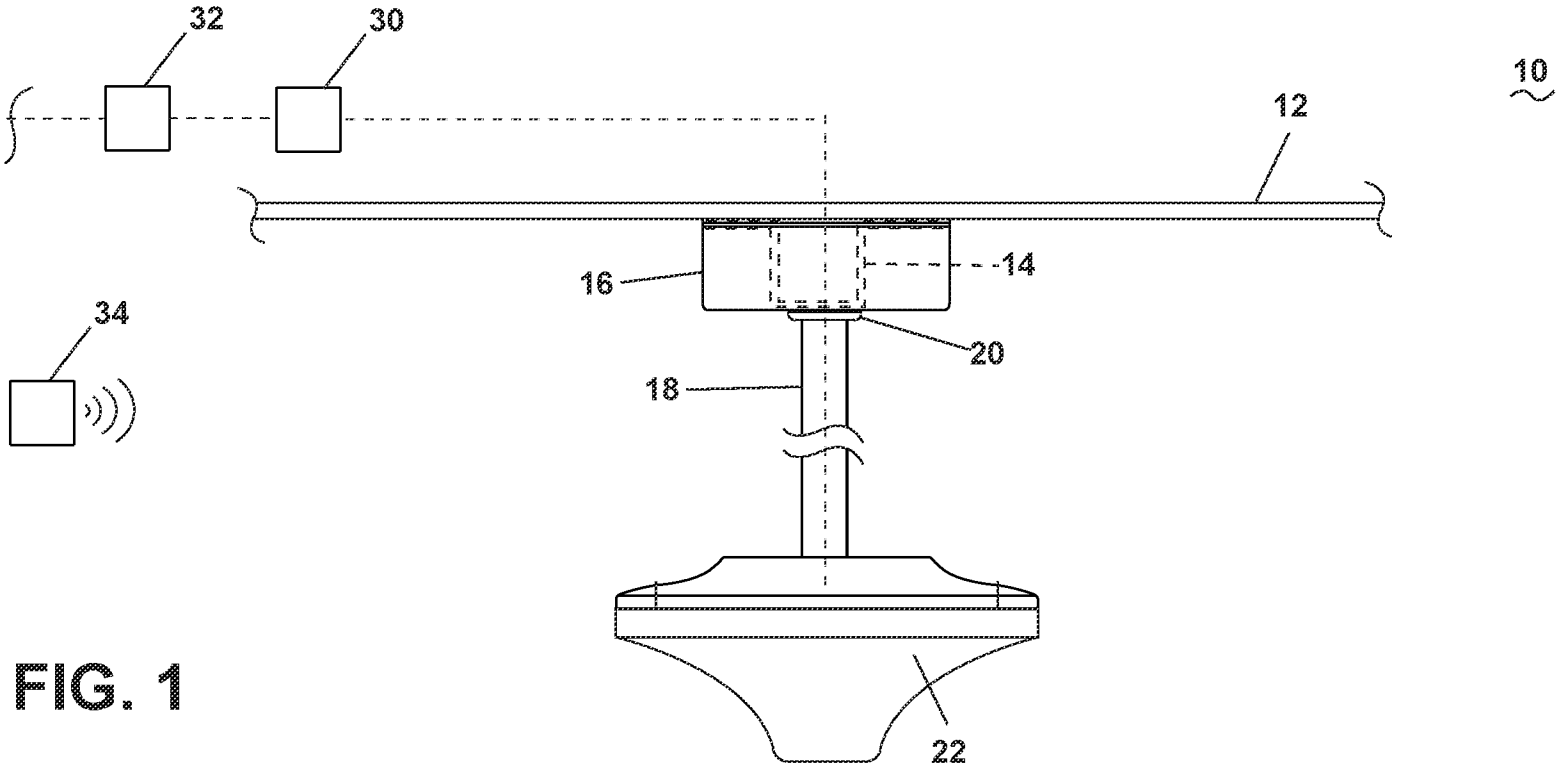
FIG. 1 is a schematic view of a light suspended from a structure.

The disclosure is related to a light and a mounting assembly therefore, which can be used, for example, in residential and commercial applications. Such applications can be indoors, outdoors, or both. While this description is primarily directed toward a residential light, it is also applicable to any environment requiring or utilizing suspended lighting about a space.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a light assembly 10 is suspended from a structure 12. In non-limiting examples, the light assembly 10 can include one or more light components including, but not limited to, a hanger bracket 14, canopy 16, a downrod 18, a ball mount 20, and a light 22. The structure 12 can be a ceiling, for example, from which the light assembly 10 is suspended. While FIG. 1 depicts the structure as generally horizontal, other aspects are not so limited. As will be described in more detail herein, it is contemplated that in other non-limiting aspects, the structure 12 can be sloped. For example, the structure 12 can be oriented obliquely with respect to the horizontal. It should be understood that the structure 12 is schematically shown and is by way of example only, and can include any suitable building, structure, home, business, or other environment wherein illuminating a space is suitable or desirable.

An electrical supply 30 can supply power to the light assembly 10. A controller 32 can be electrically coupled to the electrical supply 30 to control operation of the light assembly 10, such as a wall-mounted switch coupled to the electrical supply 30. Alternatively, another controller can be wirelessly or communicatively coupled to the light assembly 10, configured to control operation of the light assembly 10 remotely. Non-limiting examples of controls for the light assembly 10 can include on, off, dim, color, timer, or other light settings. Furthermore, the wireless controller 34 can be used alone or in addition to the wired controller 32, and can be communicatively coupled to a controller or a wireless receiver in the light assembly 10 to control operation of the light assembly 10. It is further contemplated, in one alternative example, that the light assembly 10 be operated by the wireless controller 34 alone, and is not operably coupled with the wired controller 32. Non-limiting examples of a wireless controller 34 can include a light remote control, a smart device like a smart phone or computer, or via wireless network.

Figure 2:
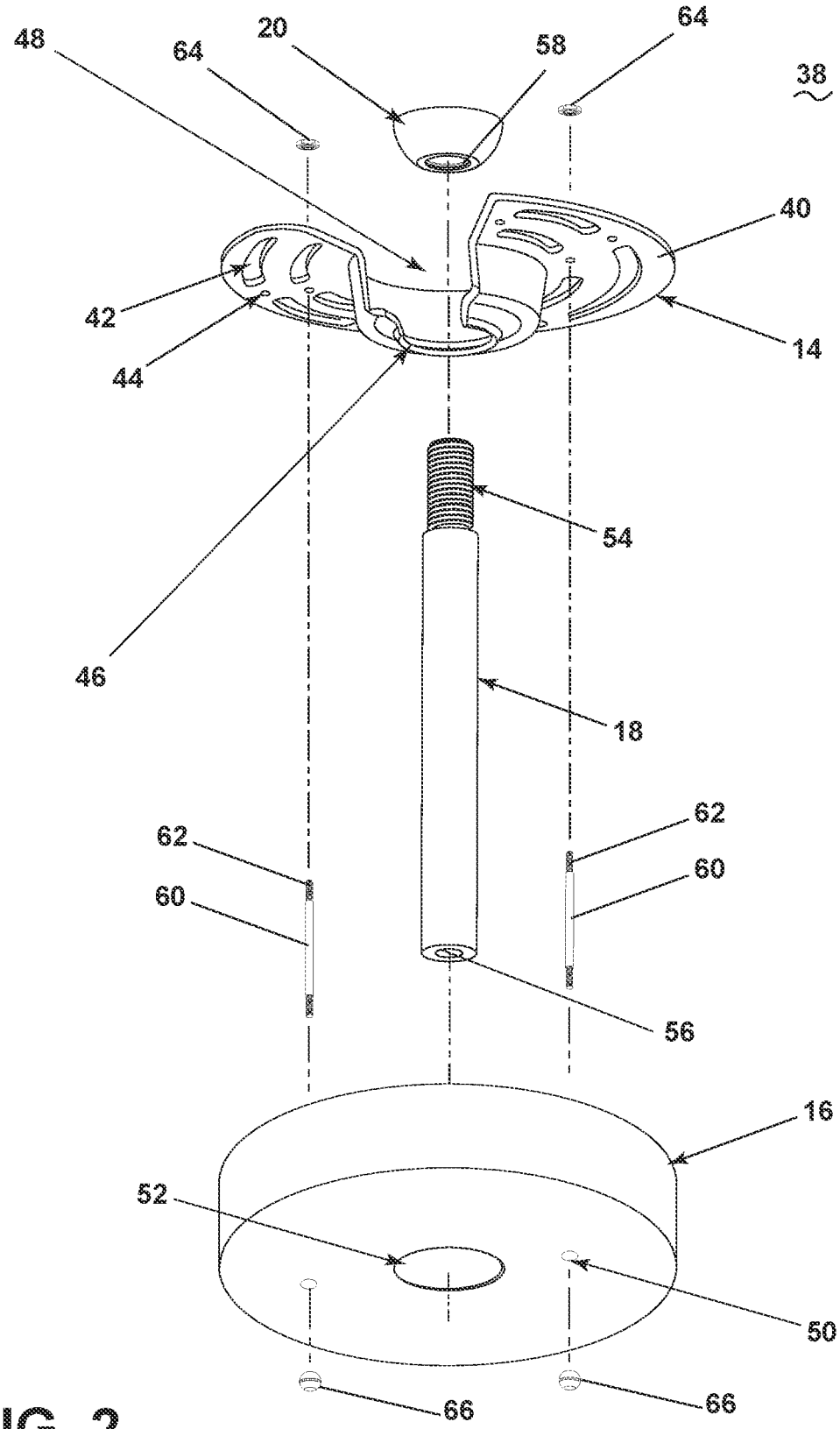
FIG. 2 is an exploded view of the light of FIG. 1, including a canopy and a hanger bracket.

Referring to FIG. 2, a mounting assembly 38 can include the hanger bracket 14, the canopy 16, the downrod 18, and the ball mount 20. The hanger bracket 14 includes a top plate 40 with a set of mount openings 42 and a set of fastener openings 44. The mount openings 42 can be used to mount the hanger bracket 14 to the structure, and the fastener openings 44 can be used to mount the canopy 16 to the hanger bracket 14. A seat 46 extends from the top plate 40 and includes an open mouth 48. The seat 46 can be shaped to receive the ball mount 20. The open mouth 48 can be sized to receive the downrod 18, while also shaped to prevent the ball mount 20 from moving from the seat 46.

The canopy 16 includes a pair of fastener holes 50, which can be provided on opposing sides of a central opening 52. The central opening 52 can be sized to receive the downrod 18 or a portion of the ball mount 20. The downrod 18 can include a threaded end 54 and a hollow interior 56. The ball mount 20 can include a threaded opening 58 adapted to threadably couple to the downrod 18 at the threaded end 54.

During assembly, the hanger bracket 14 can fasten to the ceiling or structure from which the light is to be suspended. In one example, fasteners, such as screws, can be used to secure the hanger bracket 14 to the structure through the mount openings 42, while other suitable mount methods are contemplated. The ball mount 20 attaches to the downrod 18 by threading the threaded end 54 to the threaded opening 58. The ball mount 20 can then be seated in the seat 46. Seating of the ball mount 20 can include inserting the downrod 18 through the open mouth 48 and positioning the ball mount 20 into the seat 46 such that the downrod 18 extends below the seat 46. In this way, the downrod 18 can have a diameter that is less than the width of the open mouth 48.

The canopy 16 can be slid along the downrod 18 to mount to the hanger bracket 14. More specifically, the downrod 18 can insert through the central opening 52, and the canopy 16 can slide along the downrod 18 until the central opening 52 meets the ball mount 20. Fasteners 60 can be used to secure the canopy 16 to the hanger bracket 14 to hide the mounting assembly with the canopy 16. The fasteners 60 can have opposing threaded ends 62, while any suitable attachment method is contemplated. A set of nuts 64 or other fasteners can be used to threadably secure the fasteners 60 to the hanger bracket 14, and a set of threaded caps 66 can thread to the other threaded ends 62 passing through the fastener holes 50, thereby securing the canopy 16 to the hanger bracket 14. In an example where the fasteners 60 are screws, the caps 66 can be decorative to cover the screws after attachment of the canopy 16 to the hanger bracket 14.

This mounting system described herein provides for a simplified user installation experience. The simplified installation system provides for threading the ball mount 20 to the downrod 18, and positioning the ball mount 20 within the seat 46 by passing the downrod 18 through the open mouth 48. The fasteners 60 can be secured to the hanger bracket 14 with the nuts 64. The user can slide the canopy 16 along the downrod 18 and secure the canopy 16 to the hanger bracket 14 by aligning the fasteners 60 with the fastener holes 50, and using the caps 66 to thread to the fasteners 60. The canopy 16 can then rest on the caps 66, covering the hanger bracket 14, the seat 46, and at least a portion of the ball mount 20.

The mounting system provides for an improved user installation experience, facilitating installation. The open mouth 48 provides a simplified installation for the downrod 18 via the ball mount 20, permitting the user to attach the ball mount 20 to the downrod 18 prior to seating in the seat 46, which permits easy mounting of the downrod 18 to the hanger bracket 14. Furthermore, the assembly is simplified, reducing overall manufacture parts and costs.

It should be further appreciated that the hanger bracket 14 is primarily ornamental, and was created for the purpose of ornamenting, and the ornamental design thereof included significant decisions about how to present the hanger bracket 14 in the marketplace. While the hanger bracket 14 is intended to be hidden during its ultimate end use, the ornamental design is clearly intended to be noticed during the process of sale and noticed during installation of the hanger bracket 14. Such ornamenting provides that the article's design is a matter of concern, such as for as developing consumer recognition during the process of sale or during installation of the light including the hanger bracket 14, as well as enhancing saleable value and increasing consumer demand. Such ornamentality can be defined by one or more of the shape of the bracket, the pattern of openings, and the shape of the seat therein, as they contribute to the ornamental design as a whole.

Figure 3:
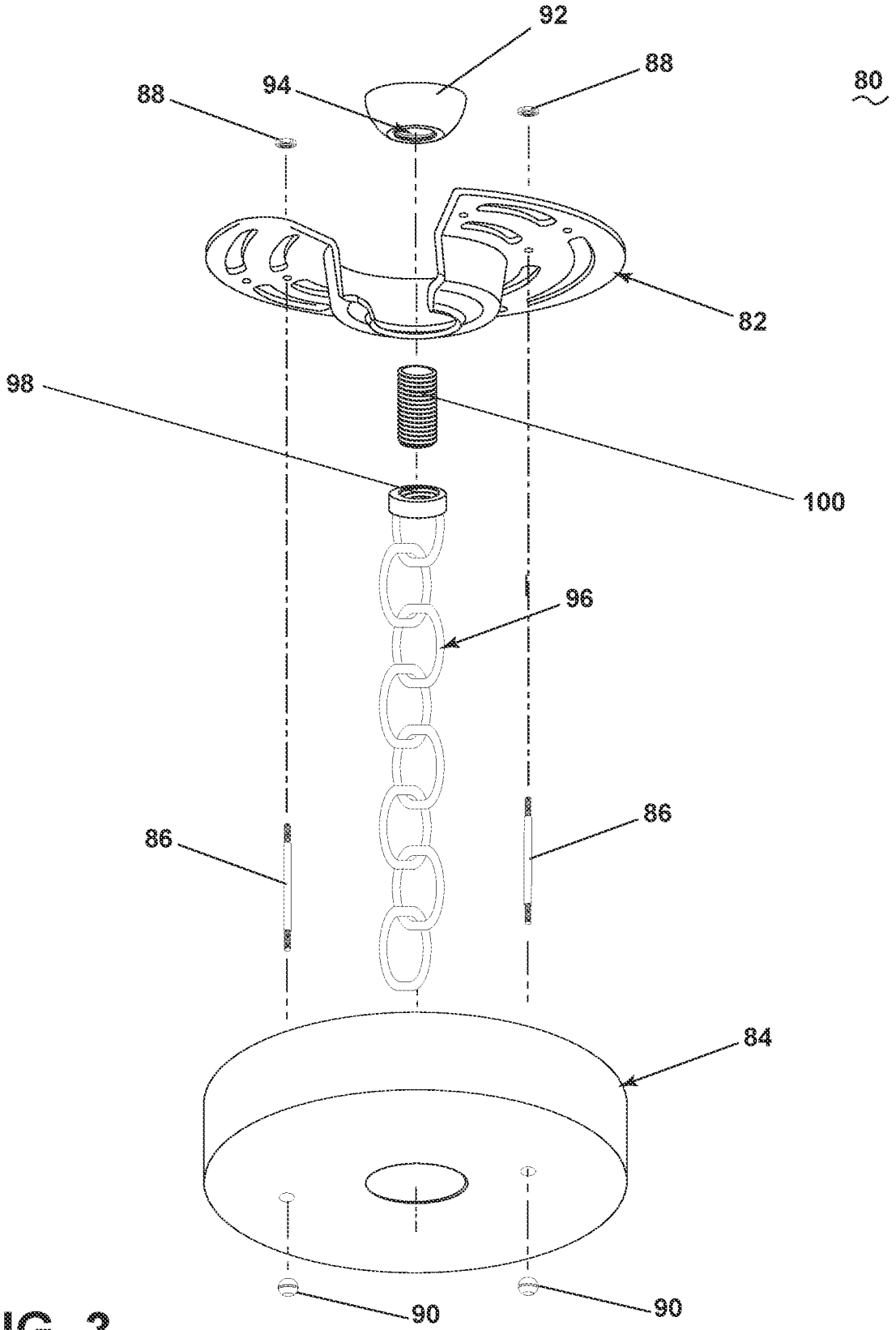
FIG. 3 is a view of an alternative light, including a chain-type suspension system.

Referring to FIG. 3, an alternate suspension assembly 80 can be substantially similar to that of FIG. 2, including a hanger bracket 82, a canopy 84, fasteners 86, nuts 88, and caps 90 which are substantially similar or the same as the hanger bracket 14, the canopy 16, the fasteners 60, the nuts 64, and the caps 66 of FIG. 2, respectively. A ball mount 92 can include a threaded opening 94. Additionally, it is contemplated that the ball mount 92 is hollow, permitting wiring to pass through to electrically couple to the light.

A suspension element is provided as a chain 96 for suspending a light element from the hanger bracket 82. The chain 96 can couple to or be formed integrally with a threaded receptacle 98. A threaded connector 100 can be used to connect the ball mount 92 to the chain 96 by fastening the threaded connector 100 to the threaded opening 94 and the threaded receptacle 98. Additionally, it is contemplated that an electrical supply can be provide to the chain 96 this way, permitting the chain to electrically supply the light without a separate electrical connection or wiring. The assembly utilizing the threaded connector 100 provides a simplified assembly system, requiring less parts and facilitating installation, which improves the user installation experience.

In an alternative example, the ball mount can include a first electrical connector and a second electrical connector can be provided on the chain 96, such as a male and a female side of a complete connection, permitting plug-in attachment of the chain 96 to the ball mount 92 via the first and second electrical connectors.

Figure 4:
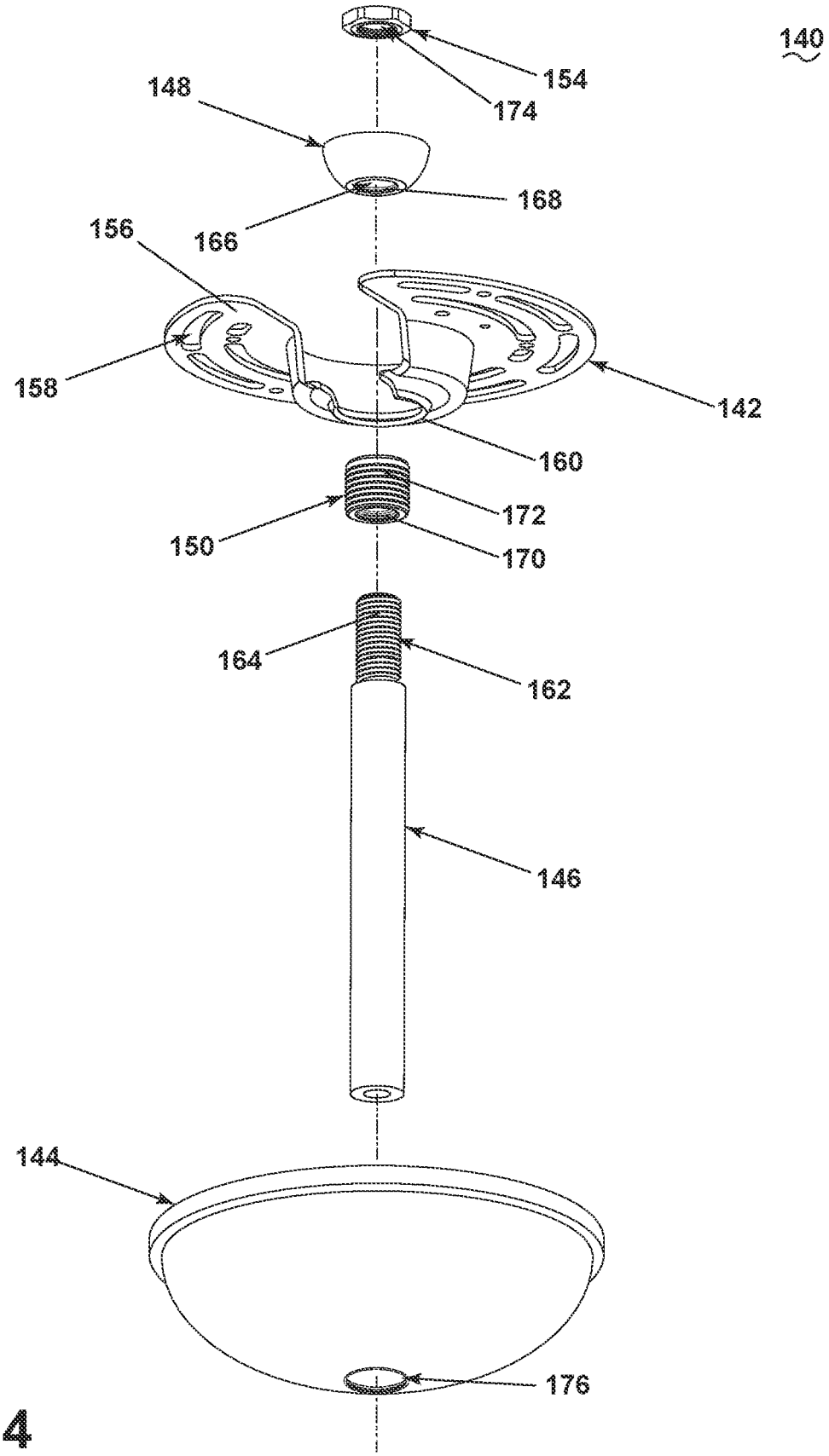
FIG. 4 is an exploded view of the light of FIG. 1 including a suspension assembly.

Referring to FIG. 4, a mounting assembly 140 provides for suspending a light assembly from a structure includes a hanger bracket 142, a canopy 144, a downrod 146, a ball mount 148, and a canopy fastener 150. The canopy 144 includes a canopy opening 176 for at least partially covering the mounting assembly 140. The hanger bracket 142 includes a mounting portion 156 with a set of openings 158 for mounting to a structure. The hanger bracket 142 also includes a seat 160 sized to receive the ball mount 148. The downrod 146 includes a first end 162 with a threaded portion 164. The ball mount 148 can include an interior opening 166 that includes a threaded surface 168 sized to thread to the threaded portion 164 of the downrod 146.

The canopy fastener 150 can be a hollow cylinder, having threads on both an interior surface 170 and an exterior surface 172. The interior surface 170 can be sized to thread to the threaded portion 164 of the downrod 146. The downrod fastener 154 can include a threaded center opening 174, similar to that of a nut, also sized to thread to the threaded portion 164 of the downrod 146. The canopy 144 can include a canopy opening 176 that is threaded and sized to thread to the exterior surface 172 of the canopy fastener 150.

Assembly of the mounting assembly 140 includes threading the canopy fastener 150 about the threaded portion 164 of the downrod 146. The ball mount 148 can thread onto the threaded portion 164 behind the canopy fastener 150, and the downrod fastener 154 can thread to the end of the threaded portion 164, securing the canopy fastener 150 and the ball mount 148 in serial arrangement. The ball mount 148 can seat within the seat 160 to suspend the downrod 146 from the hanger bracket 142. The canopy 144 can slide along the downrod 146, with the downrod 146 passing through the canopy opening 176, and thread to the exterior surface 172 of the canopy fastener 150, covering the hanger bracket 142. The canopy 144 can be threaded until it abuts the structure, and a frictional force between the canopy 144 and the structure can resist or prevent loosening of the canopy 144 from the canopy fastener 150.

Figure 5:
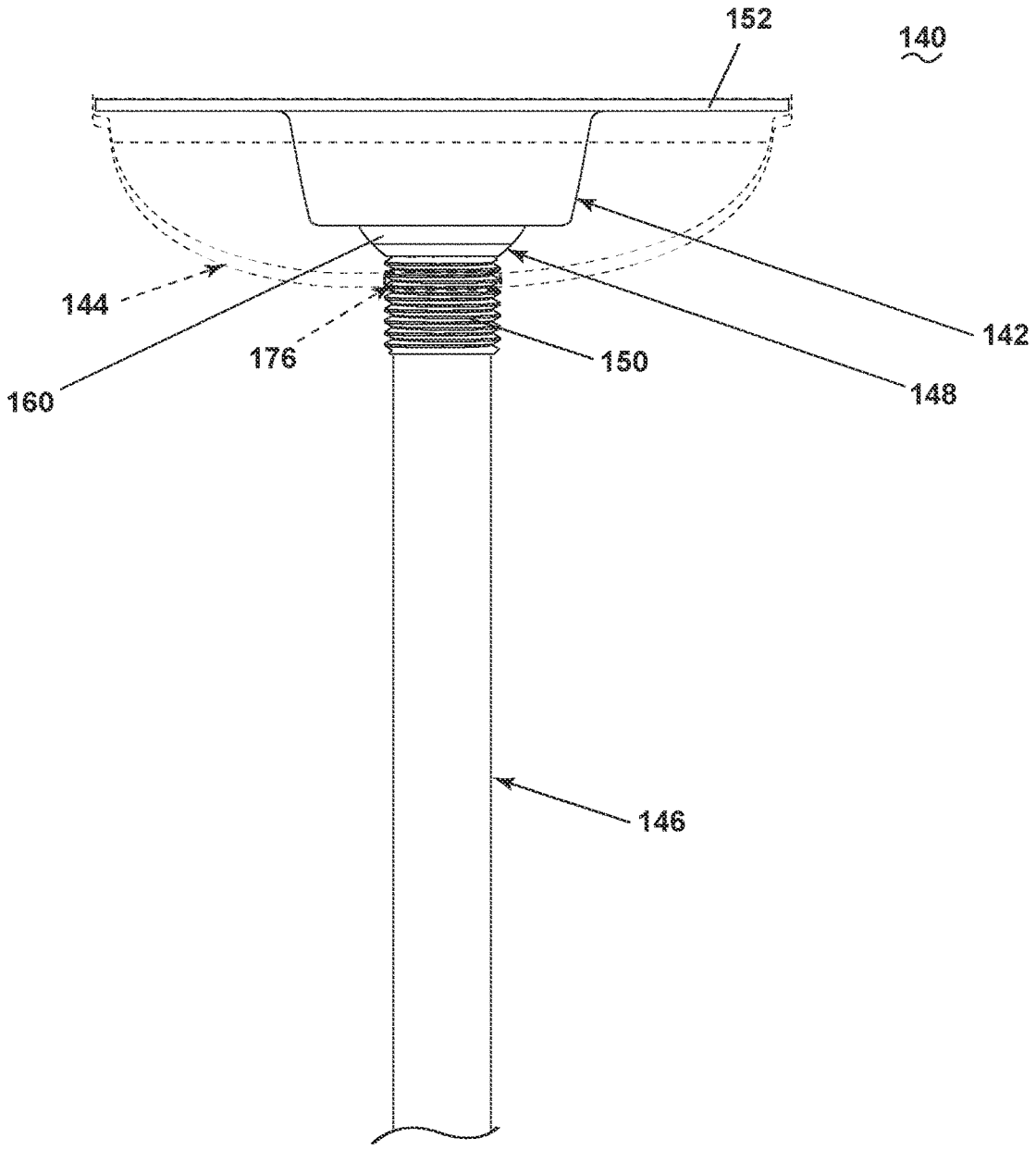
FIG. 5 shows the assembled suspension assembly of FIG. 2, with a canopy shown in broken line.

FIG. 5 shows the assembled mounting assembly 140, with the attached canopy 144 shown in broken lines. The canopy 144 threads to the canopy fastener 150 at the threaded canopy opening 176 until it abuts a structure 152. Thereafter, the remaining portions of the light assembly can be coupled to the remaining end of the downrod 146. The canopy 144 hides the hanger bracket 142, as well as at least a portion of the ball mount 148 and other portions of the mounting assembly 140, providing for a pleasant aesthetic after installation. A power connection, such as a power cable, can pass through the ball mount 148 and through downrod 146, hiding any electrical components from view.

The mounting assembly 140 provide improved ease of installation for a user. A user can mount the hanger bracket 142 to the structure 152, and can then thread the canopy fastener 150, the ball mount 148, and the downrod fastener 154 (hidden within the ball mount 148 in FIG. 5), and then easily hang and seat the ball mount 148 within the seat 160. The user then only needs to slide the canopy 144 along the downrod 146 through the canopy opening 176, and spin or rotate the canopy 144 to thread the canopy 144 to the canopy fastener 150. This improves the installation experience for the user, and provides for improved ease of installation.

Figure 6:
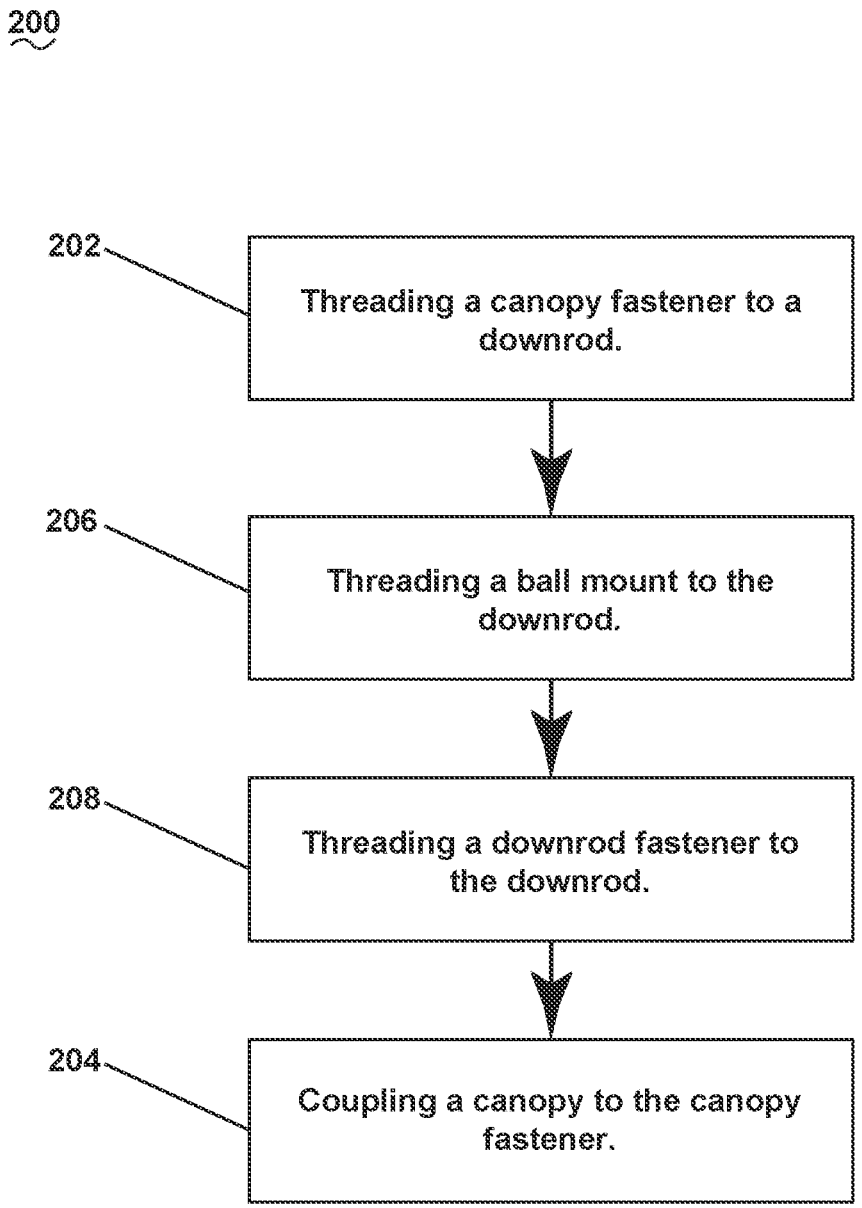
FIG. 6 is a flow chart illustrating a method of suspending a light from a structure.

FIG. 6 shows a flow chart illustrating a method 200 of suspending a light from a structure. The method 200 includes, at 202, threading the ball mount to the downrod, or alternatively, attaching a chain or other extension to the ball mount via mating electrical connectors. Such threading can include threading the canopy fastener 150 to the threaded portion 164 of the downrod 146. Furthermore, the threading can include threading an interior surface 170 of the canopy fastener 150 to the threaded portion 164 of the downrod 146.

At 204, the method 200 can include coupling the canopy 144 to the canopy fastener 150. Such coupling can include threading the canopy 144 to the canopy fastener 150, as well as threading the canopy 144 along the exterior surface 172 of the canopy fastener 150.

At 206, the method 200 can include threading the ball mount 148 to the downrod 146 along the threaded portion 164. The ball mount 148 can position behind the canopy fastener 150 securing the canopy fastener 150 in place. This can be done prior to coupling the canopy 144 to the canopy fastener 150 at 204.

At 208, the method can include threading the downrod fastener 154 to the downrod 146 along the threaded portion 164. The downrod fastener 154 can position behind the canopy fastener 150 and the ball mount 148, securing both to the downrod 146. This can also be done prior to coupling the canopy 144 to the canopy fastener 150 at 204, but should be done after the method 200 at 206 to secure the ball mount 148 and canopy fastener 150 behind the downrod fastener 154.

Figure 7:
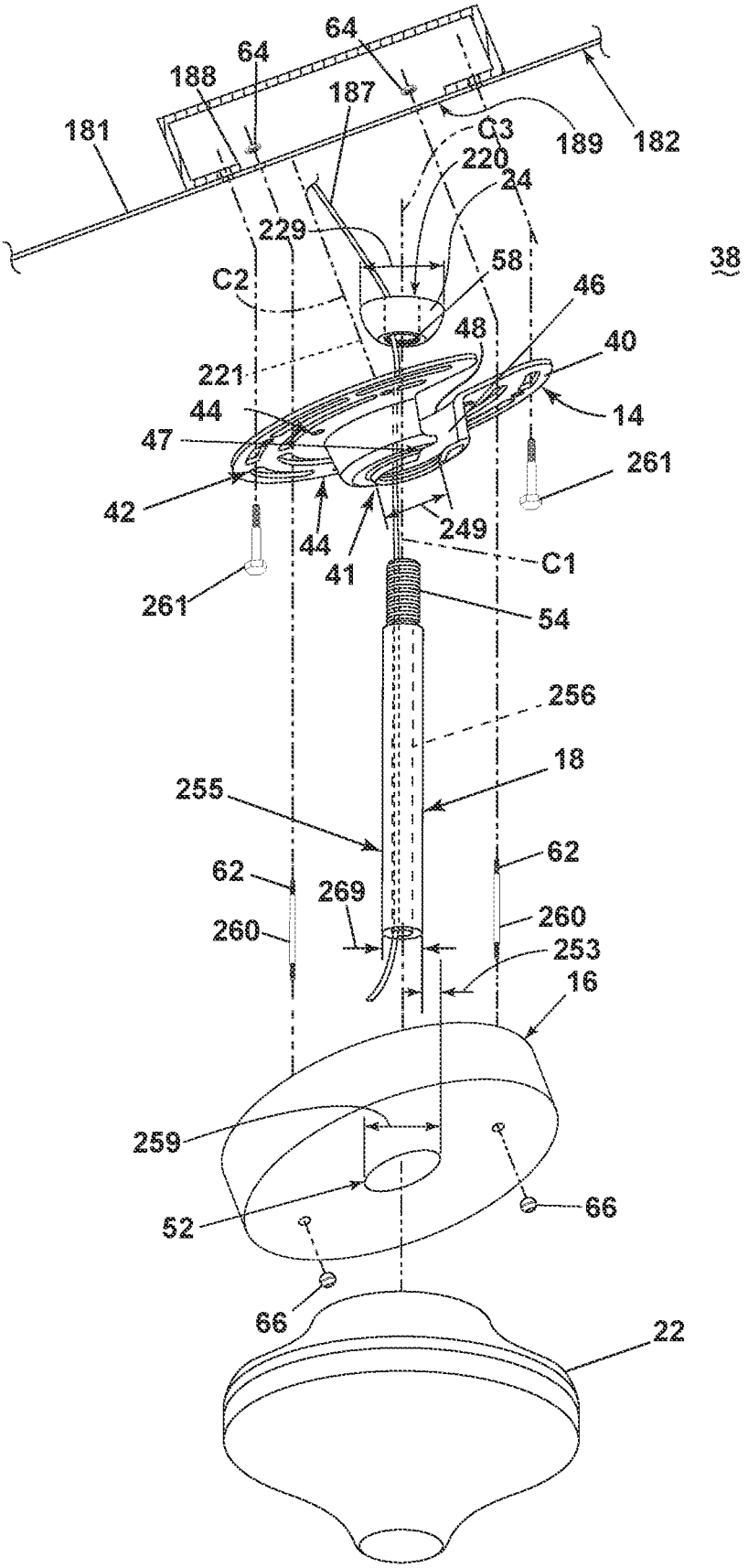
FIG. 7 is an exploded view of a mounting assembly for mounting a light to a sloped ceiling, in accordance with various aspects described herein.

Some of the already described aspects are beneficial for suspending the mounting assembly 38 from a sloped or non-horizontal surface of the structure 12. For example, referring to FIG. 7, the mounting assembly 38 is depicted in exploded view as suspended from a sloped structure 181 or ceiling, the sloped structure 181 defining a sloped surface 182. That is, the aspect of FIG. 7 is similar to the aspect illustrated in FIG. 2, with one notable difference being the aspect of FIG. 7 is arranged for mounting to a sloped surface 182. It is contemplated that the sloped structure 181 can include a conventional electrical junction box 188 having a face 189 opening onto the sloped surface 182. As will be appreciated, the conventional electrical junction box 188 can have a set of predetermined fastening openings (not shown), which can be tapped openings.

The mounting assembly 38 shown in FIG. 7 can include the hanger bracket 14, the canopy 16, the downrod 18, the ball mount 20, a set of first fasteners 261 and a set of second fasteners 260. The hanger bracket 14 can include the top plate 40 with the set of mount openings 42 and the set of fastener openings 44. The seat 46 extends from the top plate 40 and includes the open mouth 48. The seat 46 can be shaped to receive the ball mount 20. The open mouth 48 can be sized to receive the downrod 18, while also shaped to prevent the ball mount 20 from moving from the seat 46. The seat 46 can include a flange 47, which can, at least partially, define the open mouth 248. The ball mount 20 can have an outer curved surface 24, and the seat 46 can be shaped to receive the outer curved surface 24 of the ball mount 20. As shown, the seat 46 can also define a downrod opening 41 sized to receive the downrod 18 therethrough. In non-limiting aspect, the open mouth 48 and downrod opening 41 can cooperatively define a single opening.

The hollow interior 56 of the downrod 18 can define a first internal wire passage 219 to provide a passage for electrical wiring 187. In some aspects, the first internal wire passage 219 can extend through the first and second ends 54, 255 of the downrod 18. Similarly, the ball mount 20 can define a hollow interior 239, which can define a second internal wire passage 223. In non-limiting aspects, the second internal wire passage 223 can be coupled to the first internal wire passage 219 to provide a passage for electrical wiring 187. For example, the electrical wiring 187 can comprise a conventional power cable.

The downrod 18 can include the threaded first end 52, and an opposing second end 255, and the hollow interior 256. The downrod 18 can define a first width 269 and a longitudinal first centerline C1. The downrod opening 41 of the hanger bracket 14 can define an axial second centerline C2. The ball mount 20 can define a second width 229 and a third centerline C3. The downrod opening 41 of the hanger bracket 14 can define a third width 249. The central opening 52 of the canopy 16 can define a fourth width 259. The fourth width 259 can be larger than the first width 269 such that the central opening 52 is sized to receive the downrod 18 therethrough. In non-limiting aspects, the third width 249 can be greater than the first width 269, and the second width 229 can be greater than the third width 249.

The light 22 can be affixed to the downrod 18 proximate to the second end 255. The canopy 16 can be positioned on the downrod 18 between the ball mount 20 and the light 222.

Figure 8:
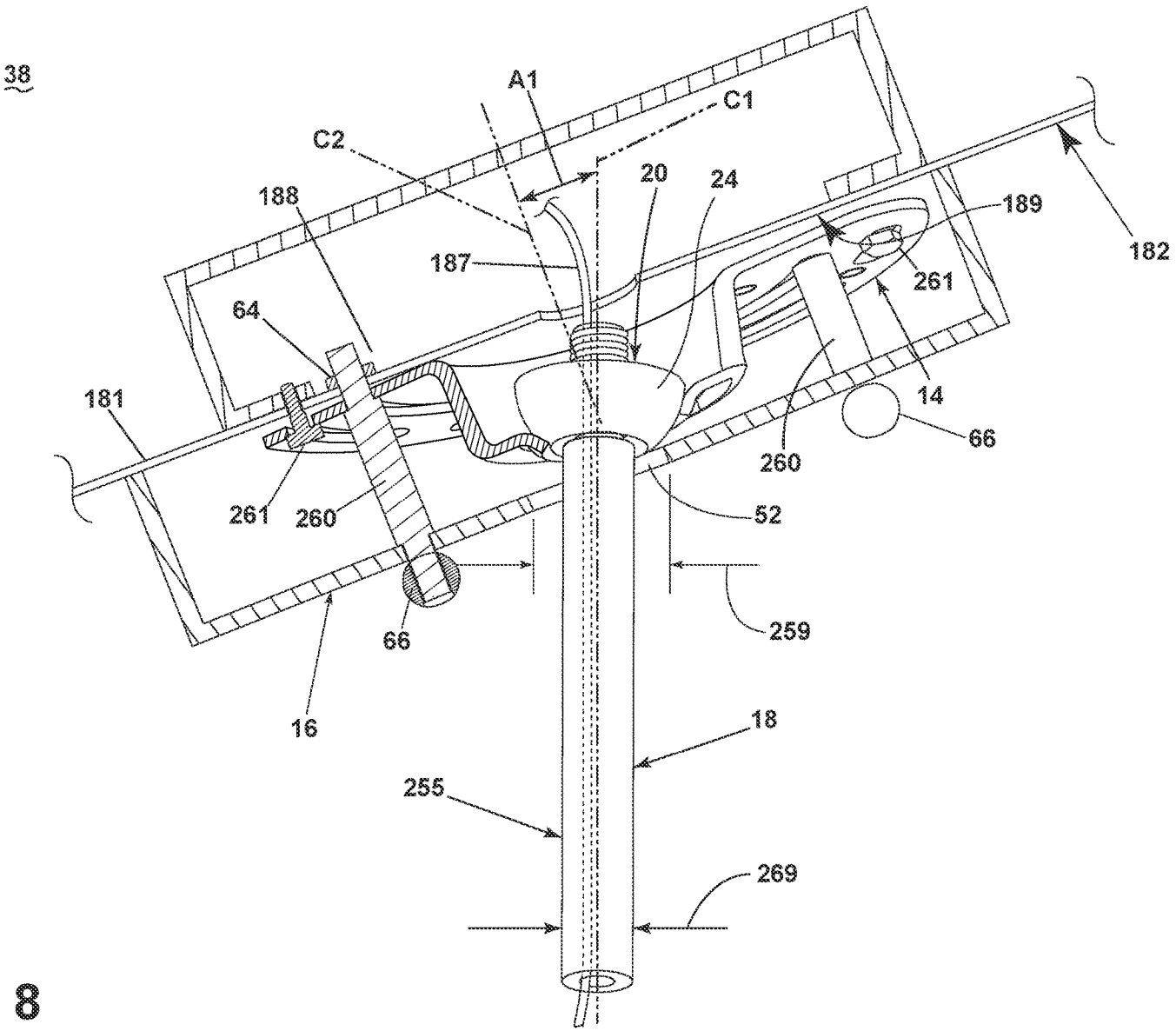
FIG. 8 is a partial cross section of the mounting assembly of FIG. 7 in an assembled condition, in accordance with various aspects described herein.

FIG. 8 depicts a cross section of the mounting assembly 38 of FIG. 7, assembled and mounted to the sloped structure 181, with some parts (e.g., the light 22) omitted for clarity. As shown, the hanger bracket 214 can be threadably secured to the junction box 188 via the set of first fasteners 261. In some aspects, when the hanger bracket 14 is secured to the sloped surface 182, the second centerline C2 can be substantially orthogonal to the sloped surface 182.

With simultaneous reference to FIGS. 7 and 8, the mounting assembly 38 can be assembled by coupling the ball mount 20 threaded opening 58 to the downrod 18 by threading the threaded first end 54 to the threaded opening 258. The ball mount 20 can then be seated in the seat 46 by inserting the downrod 18 through the open mouth 48 and positioning the ball mount 20 into the seat 46 such that the downrod 18 extends below the seat 46 and through the downrod opening 41. In some aspects, the outer curved surface 24 can rest on the flange 47. The open mouth 48 can be sized to receive the downrod 18, while also shaped to prevent the ball mount 20 from being unseated or dislodged from the seat 46. For the greatest functional advantage, the open mouth 48 can be arranged to face "uphill" relative to the sloped surface 182.

The electrical wiring 187 may be passed between the electrical junction box 188 and the light 22 to provide power thereto. The electrical wire 187 may additionally or alternatively be passed through the second internal wire passage 223 of the ball mount 20. The electrical wiring 187 can be extended from the electrical junction box 188 through the downrod 18 and ball mount 20 between the electrical junction box 188 and the light 22. Advantageously, electrical connection between the electrical wiring 187 and other conductors such as supply cable (not shown) can be made (e.g., via wire nuts or other suitable connectors) and disposed in the electrical junction box 188, via the face 189 while the weight of the mounting assembly 38 is borne by the hanger bracket 214.

The canopy 16 can be slid along the downrod 18 to mount to the hanger bracket 214. More specifically, the downrod 18 can insert through the central opening 252, and the canopy 16 can slide along the downrod 18 until the central opening 252 meets the ball mount 20. When assembled, the ball mount 20 can rest on the seat 46 to pivotally mount the downrod 18 to the seat 46 via the ball mount 20, with the downrod 18 extending through the downrod opening 41. In non-limiting aspects, when the ball mount 20 is seated within the seat 46, the narrower third width 249 of the downrod opening 41 relative to the second width 229 of the ball mount 20 prevents the ball mount 20 from exiting the seat 46 through the downrod opening 41. In some aspects, when the hanger bracket 14 is secured to the sloped surface 182, and the ball mount 20 is received on the seat 246 and threadably coupled to the downrod 18, the first and third centerlines C1, C3 can be coaxial or substantially parallel, and the first and second centerlines C1, C2 can be substantially oblique. Furthermore, due to the pivotal mounting of the downrod 18 to the seat 46 via the ball mount 20, with the downrod 18 extending through the downrod opening 41, an angular orientation A1 between the first and second centerlines C1, C2 can be arranged. The angular orientation A1 can enable the downrod 18 to be vertically disposed, for example orthogonal to a floor surface (not shown), despite the mounting assembly 38 being suspended from the sloped ceiling surface 182. For example, in non-limiting aspects the central opening 252 can be sized relative to the downrod 18 to define a gap 253 between the canopy 16 and the downrod 18. In non-limiting aspects, the gap 253 can be sized to permit the angular orientation A1 to be at least 20-degrees (i.e., between the first and second centerlines C1, C2) without the downrod 18 contacting the canopy 16. In other aspects, the angular orientation A1 between the first and second centerlines C1, C2 can be at least 25 degrees without the downrod 18 contacting the canopy 16. In still other aspects, the angular orientation A1 between the first and second centerlines C1, C2 can be at least 30 degrees without the downrod 18 contacting the canopy 16. In yet other aspects, the angular orientation A1 between the first and second centerlines C1, C2 can be within a range of between 20 degrees and 35 degrees without the downrod 18 contacting the canopy 16.

During assembly, the hanger bracket 14 can be fastened to the sloped structure 181 or ceiling. In one example, the first fasteners 261, such as one or more screws, can be used to secure the hanger bracket 14 to the electrical junction box 188 through a corresponding mount opening 42, while other suitable mount methods are contemplated.

For example, the mount openings 42 can be used to mount the hanger bracket 14 to the sloped structure 181, and the fastener openings 44 can be used to mount the canopy 16 to the hanger bracket 214. In non-limiting aspects the set of fastener openings 44 can comprise circular openings, arcuate openings, or a combination thereof. For example, in non-limiting aspects, a first fastener 261, such as a threaded fastener, can be disposed through a respective mount opening 42 and threadably received by the electrical junction box 188 to secure the hanger bracket 14 to the electrical junction box 188.

In non-limiting aspects, a set of second fasteners 260, such as threaded fasteners, can be disposed through a respective fastener opening 44 and threadably received by the hanger bracket 14 to secure the canopy 16 to the hanger bracket 14. In this way, the canopy 16 can be secured to the hanger bracket 14 independent of the downrod 18. The second fasteners 260 can be screws, while any suitable attachment method is contemplated. The fasteners 60 can have opposing threaded ends 62, while any suitable attachment method is contemplated. A set of nuts 64 or other fasteners can be used to threadably secure the second fasteners 260 to the hanger bracket 14, and a set of threaded caps 66 can thread to the other threaded ends 62 passing through the fastener holes 50, thereby securing the canopy 16 to the hanger bracket 14. The second fasteners 260 can be passed through the fastener holes 50 and threadably secured to the hanger bracket 14, thereby securing the canopy 16 to the hanger bracket 214. The second fasteners 260 can be used to secure the canopy 16 to the hanger bracket 14 to hide the mounting assembly 38 with the canopy 16.

In this way, the canopy 16 can be secured directly to the hanger bracket 14 without need to secure the canopy 16 to the downrod 18. Furthermore, the pivotal mounting of the downrod 18 with respect to the hanger bracket 14 beneficially enables the mounting assembly 38 to be suspended from a sloped surface, while maintaining an upright or orthogonal orientation of the downrod 18 with respect to a floor surface (not shown).

It should be appreciated that the mounting assembly as described herein permits electrical connection between the electrical wiring 187 and the other conductors while the weight of the mounting assembly 38 is borne by the hanger bracket 14, prior to the attachment of the canopy 16. More specifically, the canopy 16 merely mounts to the hanger bracket 14 to cover the hanger bracket 14, without need to bear the weight of the light 22 hung below. Removing the borne weight from the canopy 16 facilitates easier electrical connections, installation of the canopy 16, as well as improving resiliency of the system, as the hanger bracket 214 bears the weight, rather than the canopy 16.

The mounting system and light assembly described herein provides for a simplified user installation experience. The light assembly provides for threading the ball mount 20 to the downrod 18, and positioning the ball mount 20 within the seat 46 by passing the downrod 18 through the open mouth 48. The second fasteners 260 can be secured to the hanger bracket 14 with the nuts 64. The user can slide the canopy 16 along the downrod 18 and secure the canopy 16 to the hanger bracket 14 by aligning the second fasteners 260 with the fastener holes 50, and using the caps 66 to thread to the second fasteners 260. The canopy 16 can then rest on the caps 66, covering the hanger bracket 14, the seat 46, and at least a portion of the ball mount 20.

The mounting system provides for an improved user installation experience, facilitating installation onto a sloped surface. The open mouth 48 enables a simplified installation for the downrod 18 via the ball mount 20, permitting the user to attach the ball mount 20 to the downrod 18 prior to seating in the seat 46, which permits easy mounting of the downrod 18 to the hanger bracket 14. It should be further appreciated that aspects as described herein enable mounting the canopy to the hanger bracket independent of the downrod. This independent mounting arrangement permits the downrod to move relative to the hanger bracket the canopy and thereby enables mounting the light assembly to a sloped ceiling wherein the canopy can be mounted parallel to the ceiling and wherein the downrod is suspended vertically. This arrangement is in contrast to prior art light assemblies having downrods that connect to the canopy, which require the downrod to extend perpendicular from the canopy and mounting surface, which practically negates a sloped ceiling mount, because it results in an undesired condition, that is, having the downrod suspended oblique to the horizontal or floor.

It should be further appreciated that the hanger bracket 214, similar to the hanger bracket 14 of FIG. 2, is primarily ornamental and was created for the purpose of ornamenting. The ornamental design thereof included significant decisions about how to present the hanger bracket 214 in the marketplace. While the hanger bracket 214 is intended to be hidden during its ultimate end use, the ornamental design is clearly intended to be noticed during the process of sale and noticed during installation of the hanger bracket 214. Such ornamenting provides that the article's design is a matter of concern, such as for as developing consumer recognition during the process of sale or during installation of the light including the hanger bracket 214, as well as enhancing saleable value and increasing consumer demand. Such ornamentality can be defined by one or more of the shape of the bracket, the pattern of openings, and the shape of the seat therein, as they contribute to the ornamental design as a whole.

It should be further appreciated that the mounting assembly as described herein permits the attachment of a canopy that does not bear the weight of the light assembly. More specifically, the canopy merely mounts to the hanger bracket to cover the hanger bracket, as opposed to bearing the weight of the light hung below. Removing the borne weight from the canopy facilitates installation of the canopy, as well as improving resiliency of the system, as the hanger bracket bears the weight, rather than the canopy.

To the extent not already described, the different features and structures of the various features can be used in combination as desired. That one feature is not illustrated in all of the aspects of the disclosure is not meant to be construed that it cannot be, but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Additional aspects are included in the following clauses:

A light assembly for mounting to a sloped ceiling defining a sloped surface and having an electrical junction box with a face opening onto the sloped surface, the assembly comprising: a hanger bracket having a top plate and a seat extending from the top plate, with the seat defining a downrod opening; downrod having opposing first and second ends, and extending through the downrod opening, a ball mount affixed to the downrod proximate to the first end and seated within the seat to pivotally mount the downrod to the seat via the ball mount; a light affixed to the downrod proximate to the second end; a canopy having a central opening through which the downrod passes, with the canopy being located along the downrod between the ball and the light; a first fastener securing the hanger bracket to the junction box; and a second fastener securing the canopy to the hanger bracket independent of the downrod; whereby the downrod is free to pivot relative to the canopy because of the pivotal mounting of the downrod to the seat and the fastening of the canopy to the hanger bracket independent of the downrod. The light assembly of the preceding clause, wherein the central opening is sized relative to the downrod to define a gap between the canopy and the downrod.

The light assembly of any preceding clause, wherein the downrod defines a first centerline and the seat defines a second centerline and the gap is sufficient to permit at least a 20-degree angular orientation between the first and second centerlines without the downrod contacting the canopy.

The light assembly of any preceding clause, wherein the angular orientation is at least 25 degrees without contact between the downrod and the canopy.

The light assembly of any preceding clause, wherein the angular orientation is up to 30 degrees without contact between the downrod and the canopy.

The light assembly of any preceding clause, wherein the first fastener comprises at least one mechanical fastener securing the top plate to the junction box.

The light assembly of any preceding clause, wherein the top plate comprises at least one arcuate opening and the at least one mechanical fastener passes through the at least one arcuate opening.

The light assembly of any preceding clause, wherein the second fastener comprises at least one mechanical fastener securing the canopy to the top plate.

The light assembly of any preceding clause, wherein the top plate comprises a first opening and the at least one mechanical faster is received within the first opening.

The light assembly of any preceding clause, wherein the canopy comprises a second opening and the mechanical fastener is also received in the second opening.

The light assembly of any preceding clause, wherein the mechanical fastener comprises a dual threaded shaft, having a first threaded end received in the first opening and a second threaded end is received in the second opening, a first nut threaded onto the first threaded end, and a second nut threaded onto the second threaded end.

The light assembly of any preceding clause, wherein the downrod includes an internal wire passage through which an electrical wire may pass between the junction box and the light.

The light assembly of any preceding clause, wherein the internal wire passage extends through the first and second ends of the downrod.

The light assembly of any preceding clause, wherein the ball mount also has a wire passage connected to the wire passage of the downrod, whereby the electrical wire may pass through the ball mount.

The light assembly of any preceding clause, wherein the first end of the downrod is threaded and the ball mount is secured to the first end.

The light assembly of any preceding clause, wherein the ball mount has an internal, threaded passage, which threadedly receives the threaded first end of the downrod.

The light assembly of any preceding clause, wherein the seat comprises a flange defining the downrod opening and the ball mount comprises a curved surface resting on the flange.

The light assembly of any preceding clause, wherein the downrod defines a first centerline and the seat defines a second centerline and the curvature of the curved surface and the shape of the flange permit at least a 20-degree angular orientation between the first and second centerlines without the downrod contacting the flange.

The light assembly of any preceding clause, wherein the angular orientation is at least 25 degrees without contact between the downrod and the flange.

The light assembly of any preceding clause, wherein the angular orientation is up to 30 degrees without contact between the downrod and the flange.

What is claimed is:

1. A light assembly for mounting to a sloped ceiling defining a sloped surface and having an electrical junction box with a face opening onto the sloped surface, the assembly comprising:

a hanger bracket having a top plate and a seat extending from the top plate, with the seat defining a downrod opening;

a downrod having opposing first and second ends, and extending through the downrod opening;

a ball mount affixed to the downrod proximate to the first end and seated within the seat to pivotally mount the downrod to the seat via the ball mount, the ball mount having a body axis and a downrod opening having a centerline that is colinear with the body axis, and the downrod is received within the downrod opening;

a light affixed to the downrod proximate to the second end;

a canopy having a central opening through which the downrod passes, with the canopy being located along the downrod between the ball and the light;

a first fastener securing the top plate of the hanger bracket to the junction box; and a second fastener securing the canopy to the top plate of the hanger bracket independent of the downrod;

whereby the downrod is free to pivot relative to the canopy because of the pivotal mounting of the downrod to the seat and the fastening of the canopy to the hanger bracket independent of the downrod.

2. The light assembly of claim 1, wherein the central opening is sized relative to the downrod to define a gap between the canopy and the downrod.

3. The light assembly of claim 2, wherein the downrod defines a first centerline and the seat defines a second centerline and the gap is sufficient to permit at least a 20-degree angular orientation between the first and second centerlines without the downrod contacting the canopy.

4. The light assembly of claim 3, wherein the angular orientation is at least 25 degrees without contact between the downrod and the canopy.

5. The light assembly of claim 4, wherein the angular orientation is up to 30 degrees without contact between the downrod and the canopy.

6. The light assembly of claim 1, wherein the first fastener comprises at least one mechanical fastener securing the top plate to the junction box.

7. The light assembly of claim 6, wherein the top plate comprises at least one arcuate opening and the at least one mechanical fastener passes through the at least one arcuate opening.

8. The light assembly of claim 1, wherein the second fastener comprises at least one mechanical fastener securing the canopy to the top plate.

9. The light assembly of claim 8, wherein the top plate comprises a first opening and the at least one mechanical faster is received within the first opening.

10. The light assembly of claim 9, wherein the canopy comprises a second opening and the mechanical fastener is also received in the second opening.

11. The light assembly of claim 10, wherein the mechanical fastener comprises a dual threaded shaft, having a first threaded end received in the first opening and a second threaded end is received in the second opening, a first nut threaded onto the first threaded end, and a second nut threaded onto the second threaded end.

12. The light assembly of claim 1, wherein the downrod includes an internal wire passage through which an electrical wire may pass between the junction box and the light.

13. The light assembly of claim 12, wherein the internal wire passage extends through the first and second ends of the downrod.

14. The light assembly of claim 13, wherein the ball mount also has a wire passage connected to the wire passage of the downrod, whereby the electrical wire may pass through the ball mount.

15. The light assembly of claim 1, wherein the first end of the downrod is threaded and the ball mount is secured to the first end.

16. The light assembly of claim 15, wherein the ball mount has an internal, threaded passage, which threadedly receives the threaded first end of the downrod.

17. The light assembly of claim 1, wherein the seat comprises a flange defining the downrod opening and the ball mount comprises a curved surface resting on the flange.

18. The light assembly of claim 17, wherein the downrod defines a first centerline and the seat defines a second centerline and the curvature of the curved surface and the shape of the flange permit at least a 20-degree angular orientation between the first and second centerlines without the downrod contacting the flange.

19. The light assembly of claim 18, wherein the angular orientation is at least 25 degrees without contact between the downrod and the flange.

20. The light assembly of claim 19 wherein the angular orientation is up to 30 degrees without contact between the downrod and the flange.

* * * * *